US006105915A

United States Patent [19]

Naman et al.

[11] Patent Number: 6,105,915

[45] Date of Patent: Aug. 22, 2000

[54] HANGER DEVICE WITH SELF-LOCKING JAWS

[76] Inventors: Marc Naman, rue Sainte-Barbe; Pascal Fornier, Route de Villemartin, both of F-73350 Bozel, France

[21] Appl. No.: 09/077,752

[22] PCT Filed: Dec. 6, 1998

[86] PCT No.: PCT/FR96/01950

§ 371 Date: Jun. 11, 1998

§ 102(e) Date: Jun. 11, 1998

[87] PCT Pub. No.: WO97/21379

PCT Pub. Date: Jun. 19, 1997

[30] Foreign Application Priority Data

Dec. 14, 1995 [FR] France ..... 95 15791

[51] Int. Cl.[7] ..... A47F 5/00

[52] U.S. Cl. ..... 248/309.1; 248/113; 248/316.3; 211/70.5

[58] Field of Search ..... 248/309.1, 110, 248/113, 231.51, 316.3, 316.2, 316.5; 211/70.5, 60.1, 66, 68

[56] References Cited

U.S. PATENT DOCUMENTS

| | | | |
|---|---|---|---|
| 101,062 | 3/1870 | Thompson | 248/113 |
| 164,088 | 6/1875 | Hunter | 248/113 |
| 243,898 | 7/1881 | Hill, Jr. | 248/113 |
| 369,318 | 9/1887 | Craine | 248/113 |
| 1,306,585 | 6/1919 | Droege et al. | 248/113 |
| 1,563,817 | 12/1925 | Wright | 248/113 |
| 1,589,616 | 6/1926 | Alford | 248/113 |
| 4,763,797 | 8/1988 | Egan | 211/70.5 |
| 5,183,164 | 2/1993 | Heinzle | 211/70.5 |
| 5,417,335 | 5/1995 | White | 211/70.5 |

FOREIGN PATENT DOCUMENTS

| | | |
|---|---|---|
| 321 861 | 6/1902 | France . |
| 38 18 031 | 11/1989 | Germany . |
| 113 521 | 3/1925 | Switzerland . |
| 193 030 | 12/1937 | Switzerland . |
| 235 542 | 4/1945 | Switzerland . |
| 342 339 | 12/1959 | Switzerland . |

*Primary Examiner*—Anita M. King
*Attorney, Agent, or Firm*—Oliff & Berridge, PLC

[57] ABSTRACT

A hanger devices which includes two jaw blocks pivoting around two pins, and link via a synchronizing assembly including a rectilinear rod of constant length connected between wooden jaw blocks.

9 Claims, 6 Drawing Sheets

HANGER DEVICE WITH SELF-LOCKING JAWS

BACKGROUND OF THE INVENTION

The present invention relates to hanger devices with self-locking jaws, for example used as wall hangers enabling an object to be held vertically.

A hanger device of this kind can comprise a base and at least a couple of two jaw blocks mounted rotating on the base according to two parallel axes, with means setting the clearance distance between the jaw blocks and the base. The jaw blocks of the couple of jaw blocks are symmetrical to one another with respect to the transverse mid-plane which separates them, and have eccentric curved bearing faces extending between a first end situated away from the axis and a second end close to the axis. The jaw blocks pivot around their respective axes between a clamping position in which the first respective end portions of bearing faces are facing one another, close to one another or pressing against one another, and a released position in which the second respective end portions of bearing faces are facing one another to leave a free space between the two jaw blocks. The object to be hung is engaged in an upward direction between the two jaws, separating the latter, after which the weight of the object tends to make the two jaws pivot in the direction of their moving towards one another, the two jaws then clamping the object on both sides and preventing it from falling.

In simple structures, described in CH-A-113,521, CH-A-193,030 or CH-A-235,542, the jaw blocks are not synchronized and pivot independently from one another.

An improvement consists in providing a synchronizing device which performs synchronization of the jaw blocks of the couple of jaw blocks according to reverse rotations around their respective axes. In this case the jaw blocks can be made of different materials and be given complex shapes, at the same time achieving the synchronizing device. But a relatively complex device then has to be produced in which the synchronizing device may sometimes bind or seize due to dust or grains of sand getting inside, so that such a device is relatively fragile and does not present the reliability required for use without precautions. This is the case, for example, in the structures with cog-wheels described in FR-A-321,861 or in DE-A-3,818,031.

SUMMARY OF THE INVENTION

The problem proposed by the present invention is to design a new structure of hanger device with self-locking jaws in which the synchronizing device presents a particularly simple, reliable and inexpensive structure, certain to exclude any risk of binding, jamming, or seizing.

Another object of the invention is to achieve such a hanger device with self-locking jaws made of simple materials, for example wood, and according to traditional machining operations, without requiring complex and onerous fitting operations.

To achieve these objects and others, in a hanger device with self-locking jaws according to the invention, the synchronizing device comprises a connecting rod with two parallel ends connected to a central part by jointed portions, the central portion of connecting rod being close to the base, the first rod end being engaged in a first hole of the first jaw block, the second rod end being engaged in a second hole of the second jaw block of the couple of jaw blocks, the first and second holes being parallel to the corresponding rotation axis and separated from said rotation axis by a preset distance, the first hole being in the zone of the first jaw block extending between the rotation axis and the second end portion of bearing face, the second hole being in the zone of the second jaw block extending between the rotation axis and the first end portion of bearing face.

According to an advantageous and simple embodiment, each jaw block is secured on the base by a screw with a head, turning freely in an axial hole of the jaw block, its head bearing against the front face of the jaw block, the end of the screw shank passing without clearance through an axial hole of the base and receiving a securing nut bearing against the rear face of the base, with a tubular spacer engaged on the screw shank and interposed between the front face of the base and the rear face of the jaw block to determine the distance separating the jaw block and the base.

BRIEF DESCRIPTION OF THE DRAWINGS

Other objects, features and advantages of the present invention will become more clearly apparent from the following description of particular embodiments made with reference to the accompanying drawings, in which.

DESCRIPTION OF THE PREFERRED EMBODIMENTS

Figure 1:
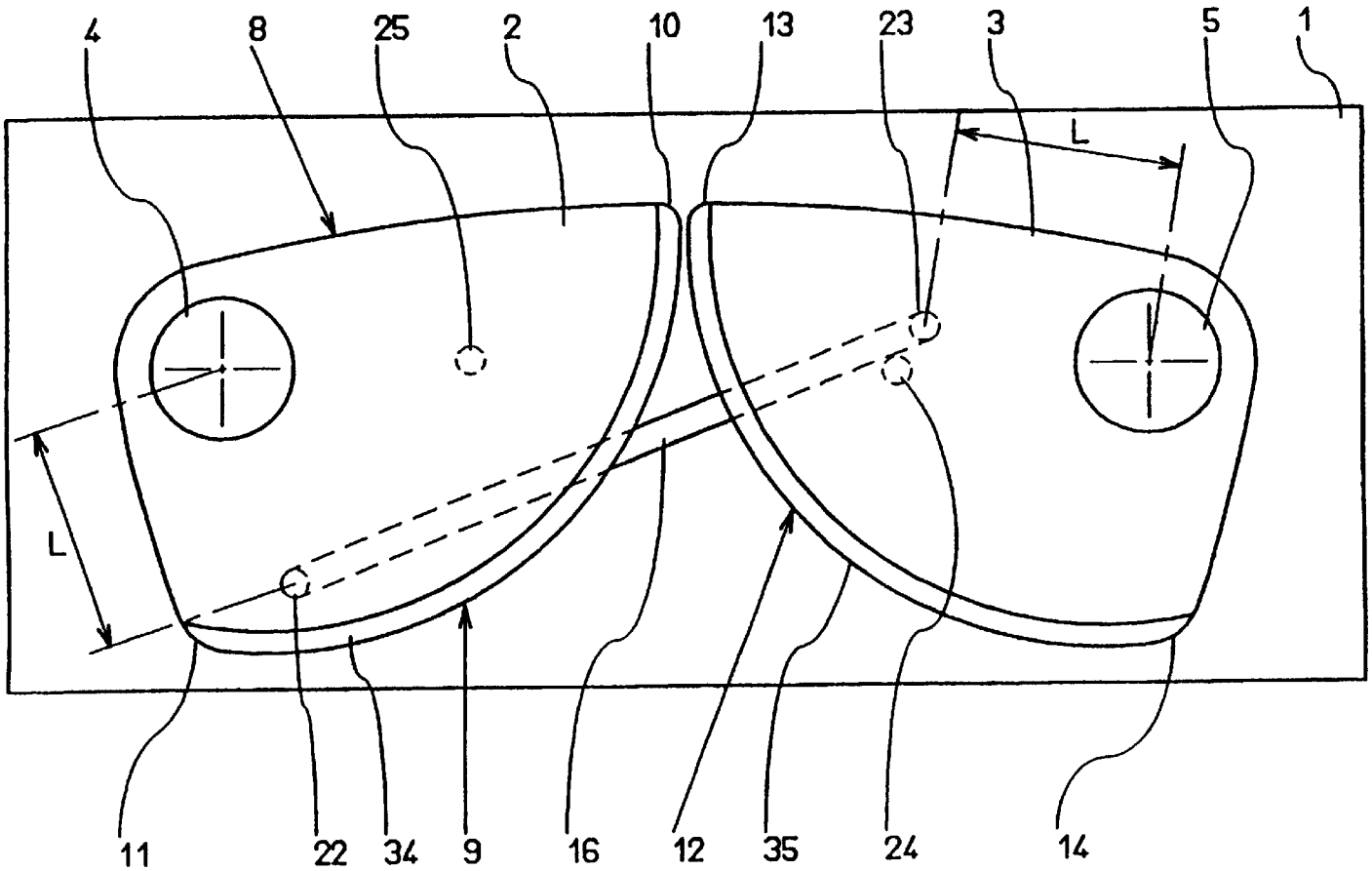
FIG. 1 is a front view of a device according to an embodiment of the present invention, the clamping position, with no object to hold.

In the embodiments illustrated in the figures, the hanger device with self-locking jaws comprises a base 1 and at least a couple of two jaw blocks 2 and 3 mounted rotating on the base 1 according to two respective parallel axes 4 and 5. As can be seen in particular in FIGS. 3, 6 and 7, means such as spacers 32 determine the distance E between the jaw blocks 2 and 3 and the base 1.

Each of the jaw blocks such as the jaw block 2 is limited by a front face 6, a rear face 7, both flat and parallel to one another and perpendicular to the respective axis 4, and a peripheral face 8. The portion of peripheral face 8 which is facing the other jaw block is an eccentric curved bearing face 9 extending between a first end 10 situated away from the respective rotation axis 4 and a second end 11 close to the rotation axis.

Thus the second jaw block 3 comprises a bearing face 12 extending between a first end 13 and a second end 14.

Figure 2:
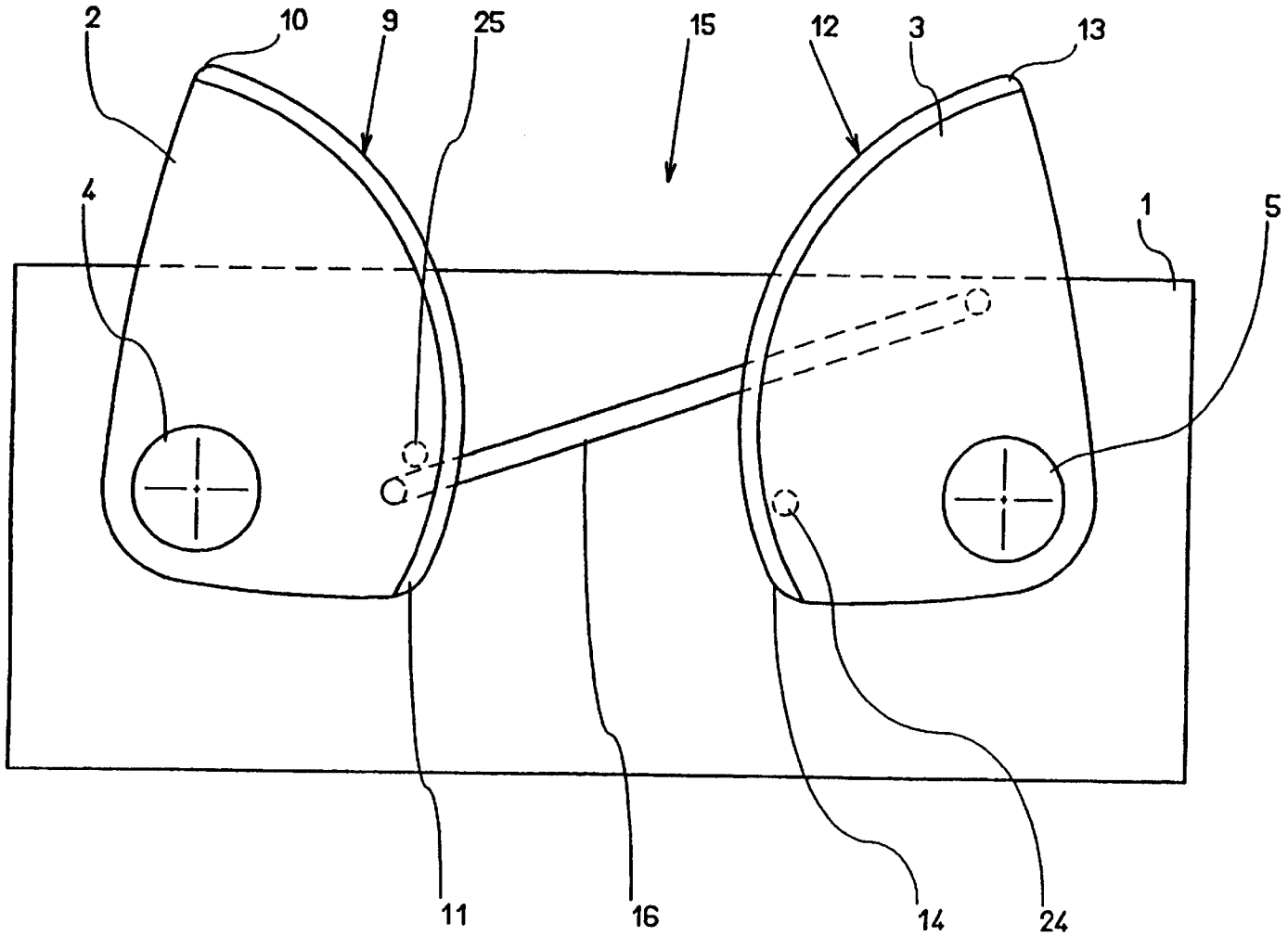
FIG. 2 is a front view of the device of FIG. 1, in the released position.

The rotation axes 4 and 5 are separated by a suitable distance so that the jaw blocks 2 and 3 can pivot between a clamping position illustrated in FIG. 1 and a released position illustrated in FIG. 2. In the clamping position illustrated in FIG. 1, the first respective end portions 10 and 13 of the bearing faces 9 and 12 are facing one another, close to or pressing against one another. In the released position illustrated in FIG. 2, the second respective end portions 11 and 14 of the bearing faces 9 and 12 are facing one another to leave a free space 15 between the two jaw blocks 2 and 3.

A synchronizing device performs synchronization of rotation of the jaw blocks 2 and 3 of the couple of jaw blocks according to reverse rotations around their respective axes 4 and 5 between a clamping position illustrated in FIG. 1 and the released position illustrated in FIG. 2.

Figure 3:
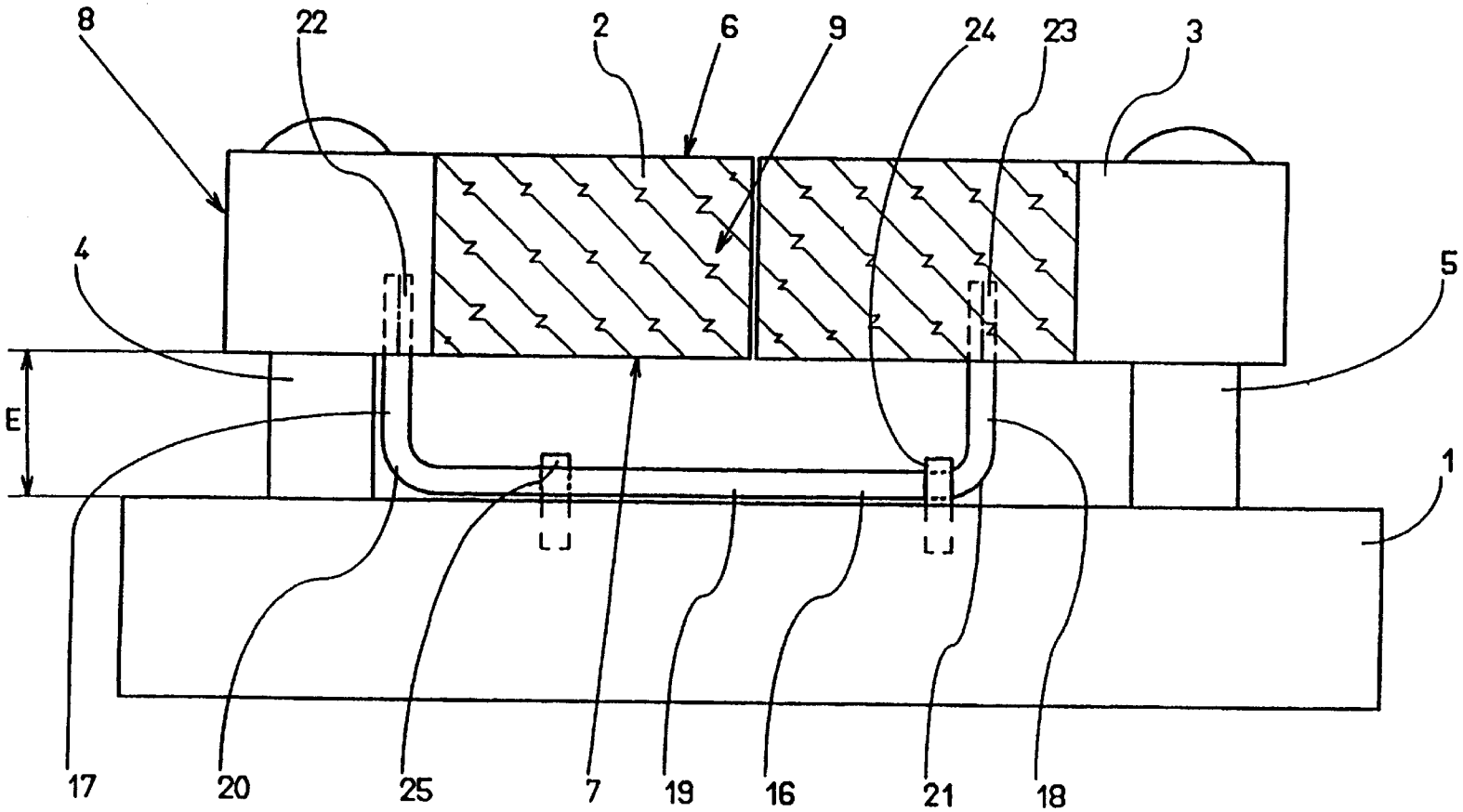
FIG. 3 is a bottom view of the device of FIG. 1.

According to the invention, the synchronizing device comprises a connecting rod 16 with two parallel ends 17 and 18, as can be seen better in FIG. 3, the ends 17 and 18 being connected to a central portion 19 by two respective jointed portions 20 and 21. The central portion 19 of connecting rod may for example be straight and be located close to the base 1.

The first rod end 17 is engaged in a first blind hole 22 of the first jaw block 2 whereas the second rod end 18 is engaged in a second blind hole 23 of the second jaw block 3 of the couple of jaw blocks. The first and second holes 22 and 23 are parallel to the corresponding rotation axis 4 or 5 and separated from said axis 4 or 5 appreciably by the same preset clearance distance L. The first hole 22 is in the zone of the first jaw block 2 extending between the rotation axis 4 and the second end portion 11 of bearing face 9. The second hole 23 is in the zone of the second jaw block 3 extending between the rotation axis 5 and the first end portion 13 of bearing face 12. In the clamping position, the connecting rod 16 is thus disposed with an oblique orientation illustrated in FIG. 1.

In equivalent manner, the connecting rod 16 can be given a reverse oblique orientation by placing the first hole 22 in the zone of the first jaw block 2 extending between the rotation axis 4 and the first end portion 10 of bearing face 9, and placing the second hole 23 in the zone of the second jaw block 3 extending between the rotation axis 5 and the second end portion 14 of bearing face 12.

By this arrangement of the connecting rod 16, it can be seen that rotation of one of the two jaw blocks 2 or 3 generates synchronized rotation of the other of the two jaw blocks 2 and 3 between the clamping and released positions, the connecting rod 16 having a constant length.

In the embodiments illustrated in the figures, a first stop 25 has in addition been represented protruding out from the base 1 and limiting the movement of the connecting rod 16 beyond the released position: in FIG. 2, the connecting rod 16 is pressing against the first stop 25 preventing any further rotational movement of the jaw blocks 2 and 3 beyond the released position.

Likewise, according to an embodiment, a second stop 24 can be provided protruding out from the base 1 and limiting the movement of the connecting rod 16 beyond the clamping position: in FIG. 1, the connecting rod 16 is pressing against the second stop 24 preventing any further rotation of the jaw blocks 2 and 3 beyond the clamping position. It can be noted that this second stop 24 may be of no use if in the clamping position the first ends 10 and 13 of bearing faces 9 and 12 of the jaw blocks 2 and 3 press against one another above the plane passing through the two rotation axes 4 and 5.

Figure 6:
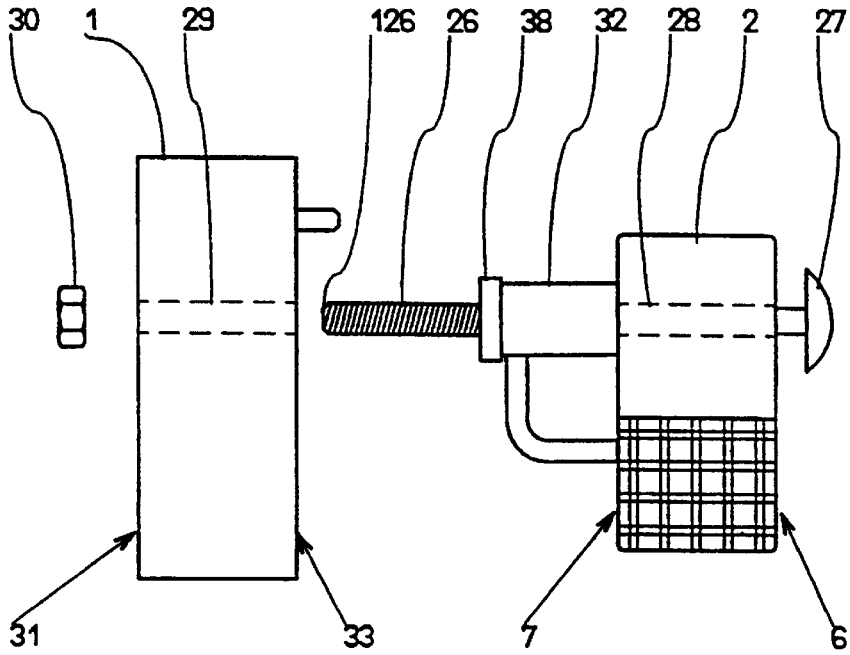
FIG. 6 is an exploded view illustrating a first embodiment of structure of a rotation axis of the jaws on the base.
Figure 7:
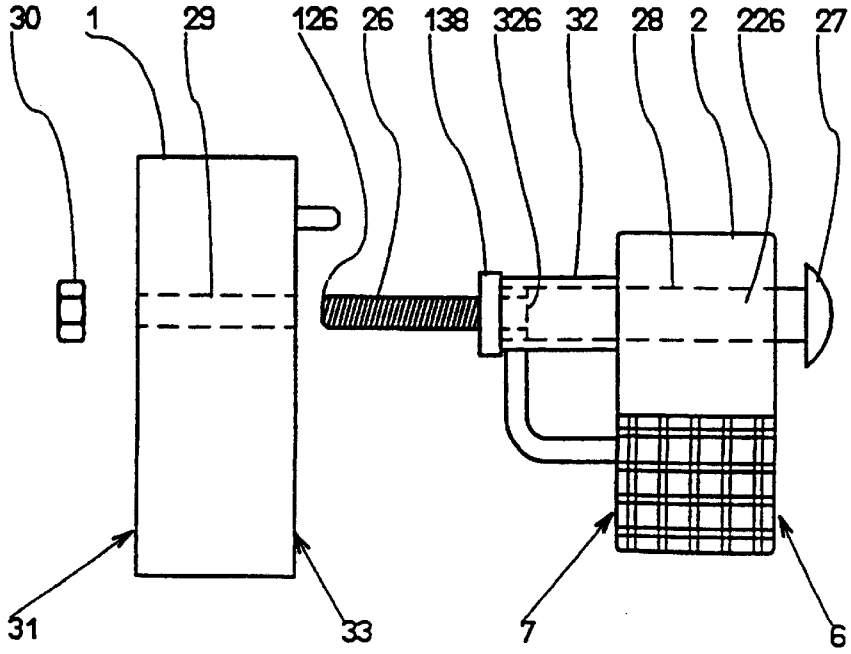
FIG. 7 illustrates a second embodiment of structure of a rotation axis of the jaws on the base.

In the embodiments illustrated in FIGS. 6 and 7, each jaw block such as the jaw block 2 is secured on the base 1 by a screw 26 with a head 27 turning freely in an axial hole 28 of the jaw block 2, the head 27 bearing against the front face 6 of the jaw block 2, the end portion 126 of screw shank 26 passing without clearance through an axial hole 29 of the base 1 and receiving a securing nut 30 bearing against the rear face 31 of the base 1. A tubular spacer 32 is engage on the screw shank 26 and fitted between the front face 33 of the base 1 and the rear face 7 of the jaw block 2 to determine the distance E separating the jaw block 2 and the base 1.

In the embodiment of FIG. 6, a stop nut 38 can advantageously be provided, fitted on the intermediate part of the screw shank 26, to secure the base 1 on both its faces.

In the preferred embodiment of FIG. 7, the screw 26 with head 27 comprises a proximal shank part 226 with a smooth external surface and of a length slightly greater than the thickness of the jaw block 2 increased by the length of the spacer 32. The proximal shank part 226 is connected by a shoulder 326 to the end portion 126 of rod itself threaded and of reduced cross section. On assembly, a washer 138 is engaged between the shoulder 326 and base 1. The freedom of rotation of the jaw block 2 is thus improved at low cost and fitting is made easier.

The base 1 may advantageously be made of wood. The jaw blocks may also be made of wood.

The bearing faces 9 and 12 of the jaw blocks 2 and 3 are preferably covered by a coating 34 or 35 of elastically compressible and anti-slip material.

In the embodiments illustrated in the figures, the base 1 is generally parallelepipedic and flat. The base supports, on one of its main faces, a single couple of two jaw blocks 2 and 3.

As an alternative, a base 1 can be provided formed by a strip elongate according to a longitudinal axis and supporting, on one of its main faces, a row of several couples of jaw blocks identical to the jaw blocks 2 and 3, whose first ends of bearing faces are situated on the same side of the longitudinal axis of the base.

Figure 4:
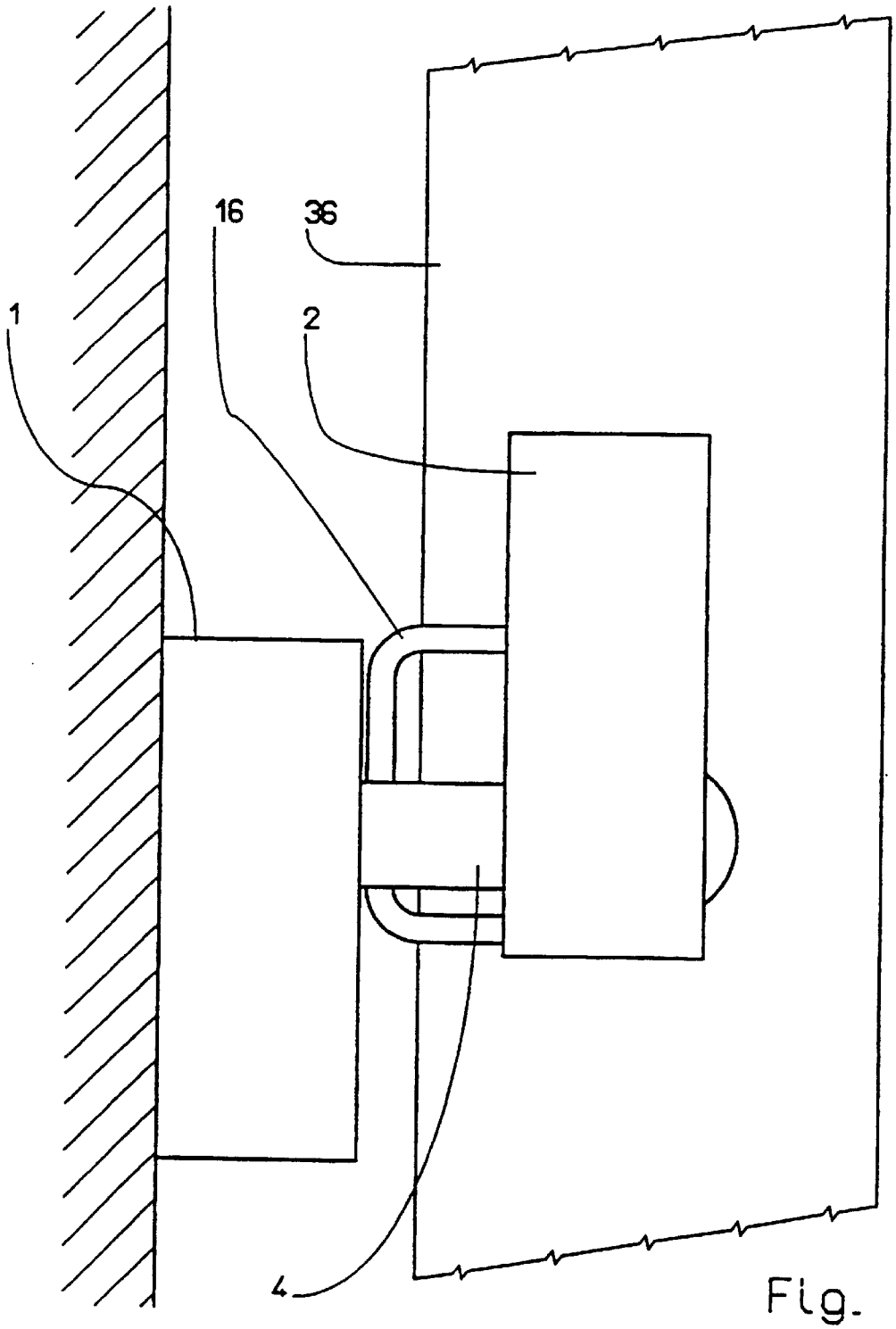
FIG. 4 is a side view of the device of FIG. 1, in the clamping position of an object to hold it.
Figure 5:
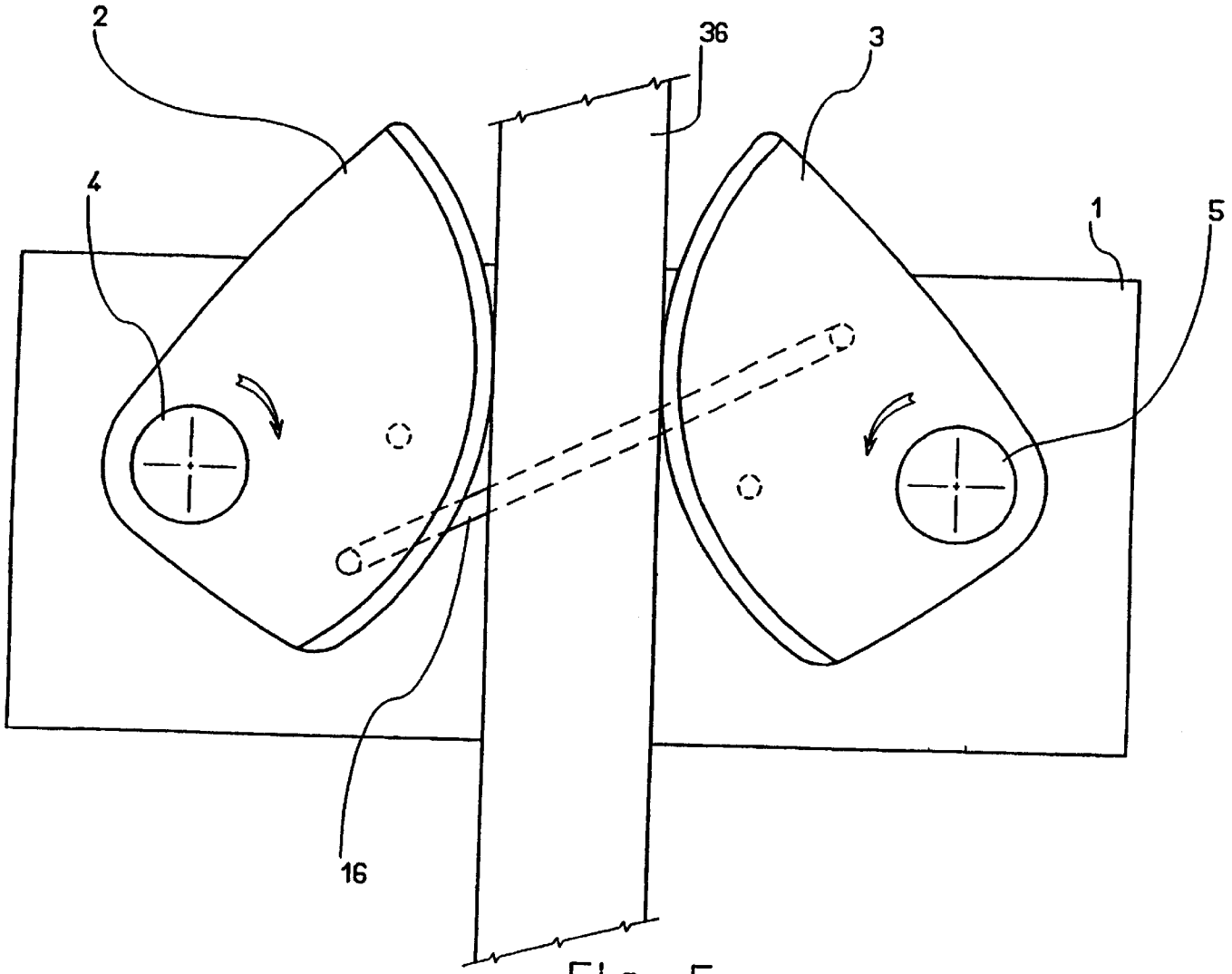
FIG. 5 is a front view of the device of FIG. 4, in the clamping position of the object.

In use, as illustrated in FIGS. 4 and 5, the base 1 is fixed to a wall so that the two axes 4 and 5 are horizontal and placed appreciably in the same horizontal plane. An object 36, such as a snowboard, can be engaged between the two jaw blocks 2 and 3 in the intermediate opening position and the own weight of the object 36 tending to pull it downwards causes rotation of the jaw blocks 2 and 3 in the direction of clamping so that the jaw blocks 2 and 3 clamp the object 36 preventing it from moving downwards. To unhook the object, the latter simply has to be moved slightly upwards. Likewise, to engage the object between the jaw blocks 2 and 3 initially in the clamping position of FIG. 1, the object 36 simply has to be engaged by moving it upwards so that it presses against the intermediate part of the jaw blocks 2 and 3, and the jaw blocks 2 and 3, by rotation, separate to enable engagement of the object 36 to the position illustrated in FIG. 5.

The present invention is not limited to the embodiments which have been explicitly described but it includes the various alternatives and generalisations contained within the scope of the claims set out hereafter.

What is claimed is:

1. A hanger device having a transverse mid-plane with self-locking jaws, comprising:

a base and at least two jaw blocks mounted rotatably on the base by a first axis and a second axis which are parallel, and being symmetrical to one another with respect to the transverse mid-plane separating them, means for setting a clearance distance between the at least two jaw blocks and the base, the at least two jaw blocks having eccentric curved bearing faces extending each between a first end situated away from the two parallel axis and a second end close to the axis, a synchronization device performing synchronization of the at least two jaw blocks by reverse rotation movements around the first axis and the second axis between a clamping position in which the first ends of the bearing faces are facing one another, close to one another or pressing against one another, and a released position in which the second ends of the bearing faces are facing one another to leave a free space between the at least two jaw blocks, a connecting rod of the synchronization device having a constant length, and including a first parallel end and a second parallel end connected to a central rectilinear part by jointed portions, the central portion being close to the base, the first end of the rod being engaged in a first hole of a first jaw block, the second end of the rod being engaged in a second hole of a second jaw block, so as the first hole and the second hole are parallel to the first axis and the second axis and separated from the first axis and the second axis by a present distance, the first hole being in the zone of the first jaw block extending between the first axis and the second end of the bearing face of the first jaw block, the second hole being in the zone of the second jaw block extending between the second axis and the first end of the bearing face of the second jaw block.

2. The hanger device according to claim 1, wherein the base includes a protruding first stop which limits the movement of the connecting rod beyond the released position.

3. The hanger device according to claim 2, wherein the base has a second protruding stop which limits the movement of the connecting rod beyond the clamping position.

4. The hanger device according to claim 1, wherein the first jaw block and the second jaw block each have a front face and are secured on the base by a screw turning freely in an axial hole of the first jaw block and the second jaw block, and having a screw head bearing against the front face, the screw is provided with an end portion passing without clearance through an axial hole of the base and receiving a securing nut, a tubular spacer is engaged on the screw to determine the clearance distance separating the first jaw block and the base.

5. The hanger device according to claim 4, wherein the screw comprises a smooth proximal shank part having a length slightly greater than the thickness of the first jaw block increased by the length of the spacer, connected by a shoulder to a threaded end portion of reduced cross section, with a washer engaged between the shoulder and base.

6. The hanger device according to claim 1, wherein the base is made of wood.

7. The hanger device according to claim 1, wherein the jaw blocks are made of wood.

8. The hanger device according to claim 1, wherein the bearing faces of the first jaw block and the second jaw block are covered by a coating of elastically compressible and anti-slip material.

9. The hanger device according to claim 1, wherein the base is flat and supports at least one of the first jaw block and the second jaw blocks on the same face.

* * * * *